US006200147B1

(12) United States Patent
Lan

(10) Patent No.: US 6,200,147 B1
(45) Date of Patent: Mar. 13, 2001

(54) INTERFACE DEVICE FOR INTERCONNECTING PORTABLE COMPUTERS AND COMPUTER PERIPHERAL DEVICES

(75) Inventor: Chuan-Chi Lan, Taipei (TW)

(73) Assignee: Compal Electronics, Taipei (TW)

( * ) Notice: Subject to any disclaimer, the term of this patent is extended or adjusted under 35 U.S.C. 154(b) by 0 days.

(21) Appl. No.: 09/525,677

(22) Filed: Mar. 15, 2000

(51) Int. Cl.[7] ..... H01R 13/62
(52) U.S. Cl. ..... 439/152; 439/928
(58) Field of Search ..... 439/159, 157, 439/341, 142, 372, 376, 928, 152–160, 136, 347, 137; 361/686, 728, 754, 801, 732, 725, 747

(56) References Cited

U.S. PATENT DOCUMENTS

| | | | | |
|---|---|---|---|---|
| 4,193,656 | * | 3/1980 | Ward | 439/152 |
| 4,969,830 | * | 11/1990 | Daly et al. | 439/136 |
| 5,145,389 | * | 9/1992 | Okubo | 439/159 |
| 5,435,737 | * | 7/1995 | Haga et al. | 439/157 |
| 6,115,246 | * | 9/2000 | Ohnishi | 361/686 |

FOREIGN PATENT DOCUMENTS

| | | | | |
|---|---|---|---|---|
| 3-297084 | * | 4/1990 | (JP) | 439/152 |

* cited by examiner

*Primary Examiner*—Khiem Nguyen
*Assistant Examiner*—J. F. Duverne
(74) *Attorney, Agent, or Firm*—Pillsbury Winthrop LLP

(57) ABSTRACT

An interface device includes a base, a lift mechanism, and a linkage mechanism. The base has a front end, a rear end, left and right sides between the front and rear ends, a top face adapted for placement of a portable computer thereon, a bottom face, and a connector housing. The connector housing is formed at the rear end of the base, and has an upright front wall extending upwardly from the top face of the base. A connector is mounted on the front wall of the connector housing at a predetermined height relative to the top face, and is adapted for engaging a mating connector of the portable computer. The lift mechanism is mounted on the base and is adapted for moving the portable computer upwardly and downwardly relative to the top face of the base so that the mating connector of the portable computer can register with and engage the connector on the base. The linkage mechanism is mounted on the base, and is connected operatively to the lift mechanism in order to actuate the lift mechanism.

6 Claims, 8 Drawing Sheets

INTERFACE DEVICE FOR INTERCONNECTING PORTABLE COMPUTERS AND COMPUTER PERIPHERAL DEVICES

BACKGROUND OF THE INVENTION

1. Field of the Invention

This invention relates to an interface device, more particularly to an interface device for interconnecting portable computers and computer peripheral devices.

2. Description of the Related Art

Referring to FIG. 1, a conventional interface for interconnecting a portable device and computer peripheral devices, such as printers, scanners, etc., is shown to comprise a base 12 and a connector housing 11 formed at a rear end of the base 12. The connector housing 11 has a circuit board (not shown) disposed therein, and a connector 111 projecting outwardly from an upright front wall 110 of the connector housing 12. Two slots 121 are formed respectively in the rear end of the base 12 at the bottom end of the front wall 110. A hole 122 is formed adjacent to a front end of the base 12. A slide piece 123 is disposed in the hole 122 and is slidable in a front-to-rear direction. Two lift plates 2, 3 are mounted selectively on a top face of the base 12 in order to adjust the height of a portable computer to be disposed on the top face of the base 12. Specifically, each of the lift plates 2, 3 has two protrusions 21, 31 formed at rear ends thereof and connectable respectively to the slots 121 in the base 12, and two openings 22, 32 formed adjacent to front ends thereof and corresponding to the hole 122 in the base 12. When one of the lift plates 2, 3 is disposed on the top face of the base 12 to insert the protrusions 21, 31 into the slots 121, the lift plates 2, 3 can be positioned on the top face of the base 12. As such, mating connectors of the portable computers of different heights relative to the top face of the base 12 can be aligned with and connected to the connector 111 on the connector housing 11 by displacing selectively the portable computer on the lift plates 2, 3.

However, since additional lift plates 2, 3 are required to be assembled on and disassembled from the base 12 in order to mate the mating connectors of the portable computers of different heights, manipulation of the interface device is relatively troublesome and time-consuming.

SUMMARY OF THE INVENTION

The object of the present invention is to provide an interface device for interconnecting a portable computer and computer peripheral devices, which can be manipulated conveniently in order to adjust the height of the mating connector of a portable computer relative the top face of the base.

According to the present invention, the interface device includes a base, a lift mechanism, and a linkage mechanism. The base has a front end, a rear end, left and right sides between the front and rear ends, a top face adapted for placement of a portable computer thereon, a bottom face, and a connector housing. The connector housing is formed at the rear end of the base, and has an upright front wall extending upwardly from the top face of the base. A connector is mounted on the front wall of the connector housing at a predetermined height relative to the top face, and is adapted for engaging a mating connector of the portable computer. The lift mechanism is mounted on the base and is adapted for moving the portable computer upwardly and downwardly relative to the top face of the base so that the mating connector of the portable computer can register with and engage the connector on the base. The linkage mechanism is mounted on the base, and is connected operatively to the lift mechanism in order to actuate the lift mechanism. The lift mechanism includes a pair of supports mounted movably on the base, respectively, adjacent to the left and right sides for moving upward and downward relative to the base. The supports extend in a front-to-rear direction. The linkage mechanism is connected operatively to the supports and has a slide plate operable manually to actuate the supports.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
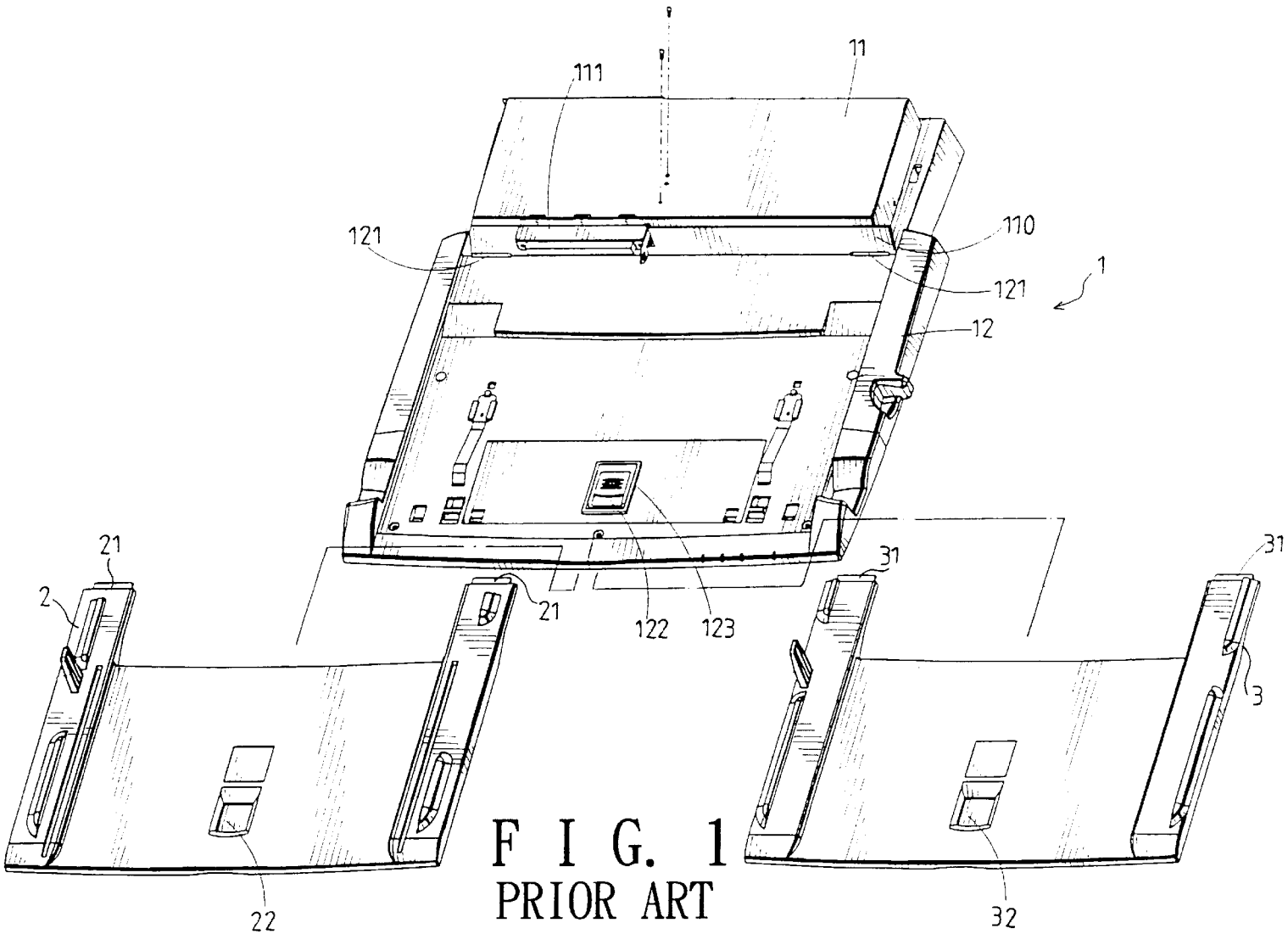
FIG. 1 PRIOR ART
FIG. 1 is an exploded view of a conventional interface device for interconnecting portable computers and computer peripheral devices.
Figure 2:
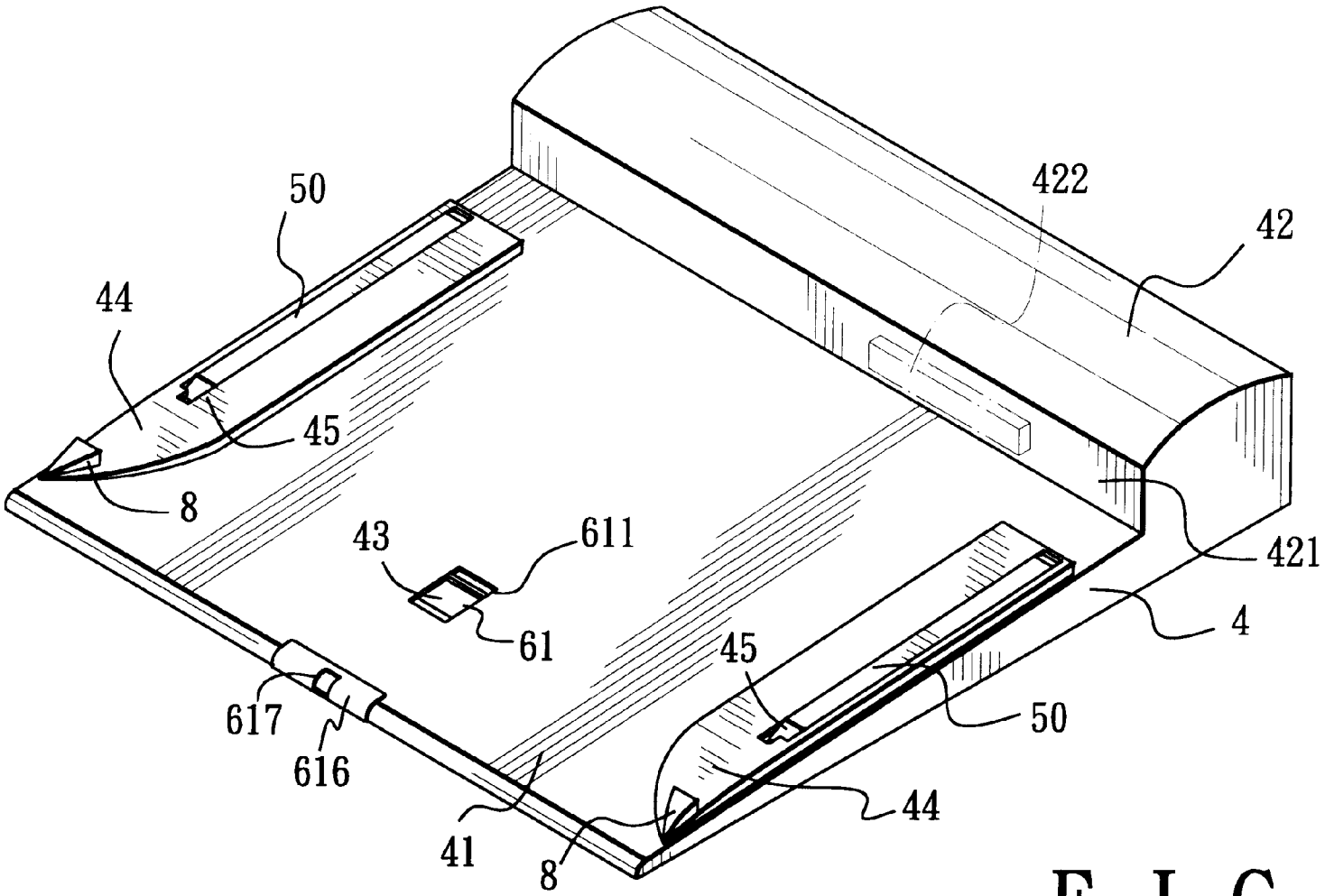
FIG. 2 is a perspective view of a preferred embodiment of an interface device for interconnecting portable computers and computer peripheral device according to the present invention.
Figure 3:
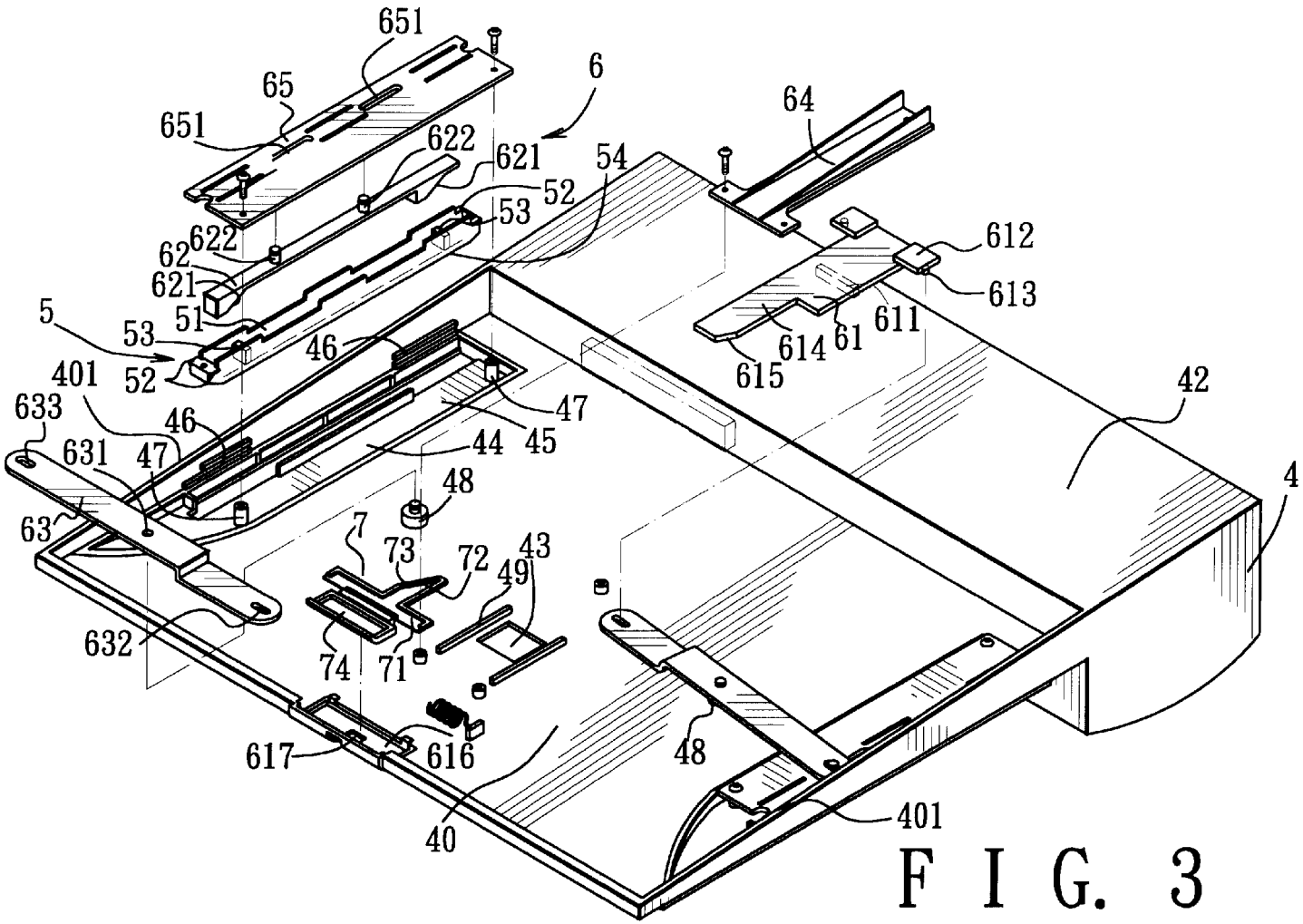
FIG. 3 is an exploded bottom perspective view of the preferred embodiment of the interface device according to the present invention.

Referring to FIGS. 2 and 3, a preferred embodiment of an interface device for interconnecting portable computers and computer peripheral devices according to the present invention is shown to comprise a base 4, a lift mechanism 5 and a linkage mechanism 6.

Figure 7:
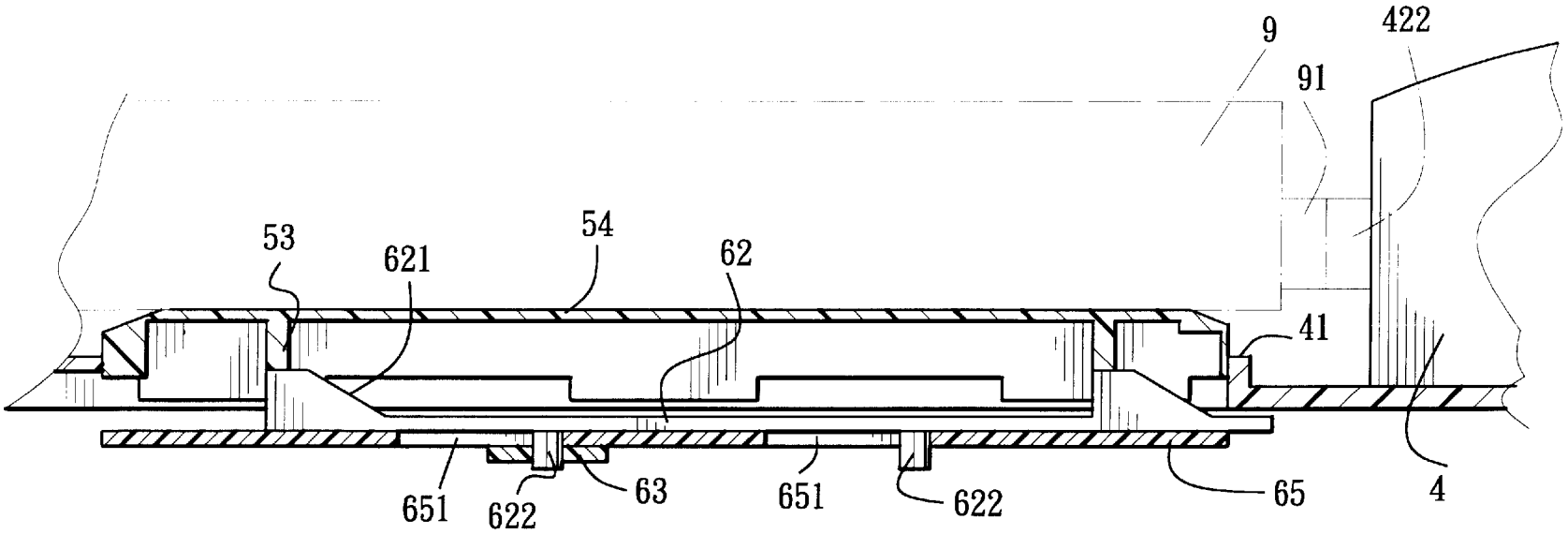
FIG. 7 is a view similar to that of FIG. 5, in which the portable computer is in an upper position on the base of the interface device.

As shown, the base 4 has a top face 41 adapted for placement of a portable computer 9 (see FIG. 5) thereon, a bottom face 40, and a connector housing 42. The connector housing 42 is formed at a rear end of the base 4, and has an upright front wall 421 extending upwardly from the top face 41 of the base 4. The connector housing 42 has a circuit board (not shown) disposed therein. A connector 422 is connected electrically to the circuit board and projects outwardly from the front wall 421 of the connector housing 42 at a predetermined height relative to the top face 41. The connector 422 is adapted for engaging a mating connector 91 of the portable computer 9, as shown in FIG. 7. The base 4 has two elongated grooves 45 respectively adjacent to left and right sides thereof and extending in a front-to-rear direction, and a hole 43 disposed between the elongated grooves 45 adjacent to a front end of the base 4. The bottom face 40 has two side walls 401 extending downwardly therefrom at the left and right sides of the base 4, respectively. Each of the side walls 401 has two pairs of positioning rails 46 extending in a direction parallel to the front-to-rear direction and formed adjacent to the front and rear ends of the base 4, respectively. Two pillars 47 are fixed on the bottom face 40 adjacent to front and rear ends of the elongated grooves 45, respectively. The hole 43 and each of the elongated grooves 45 have a pedestal 48 formed therebetween on the bottom face 40 of the base 4.

Figure 4:
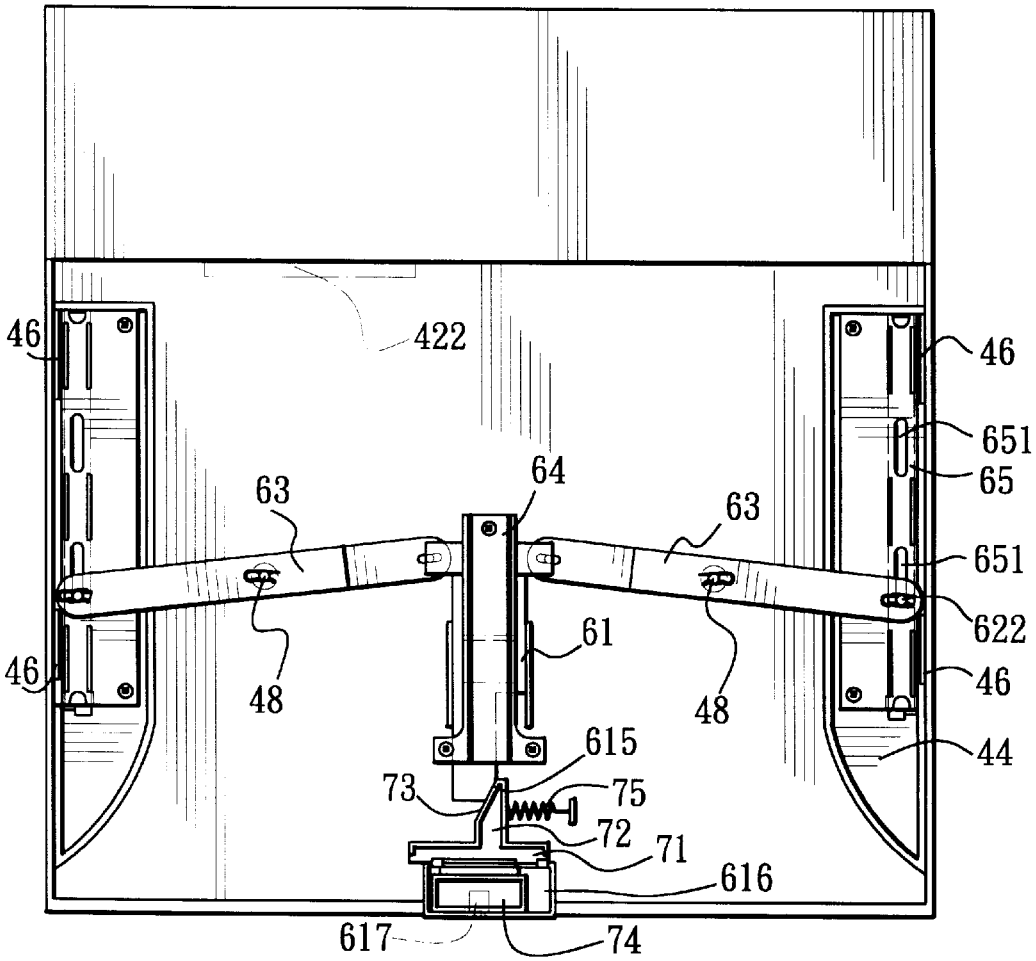
FIG. 4 is a bottom schematic view of the preferred embodiment of the interface device according to the present invention.
Figure 5:
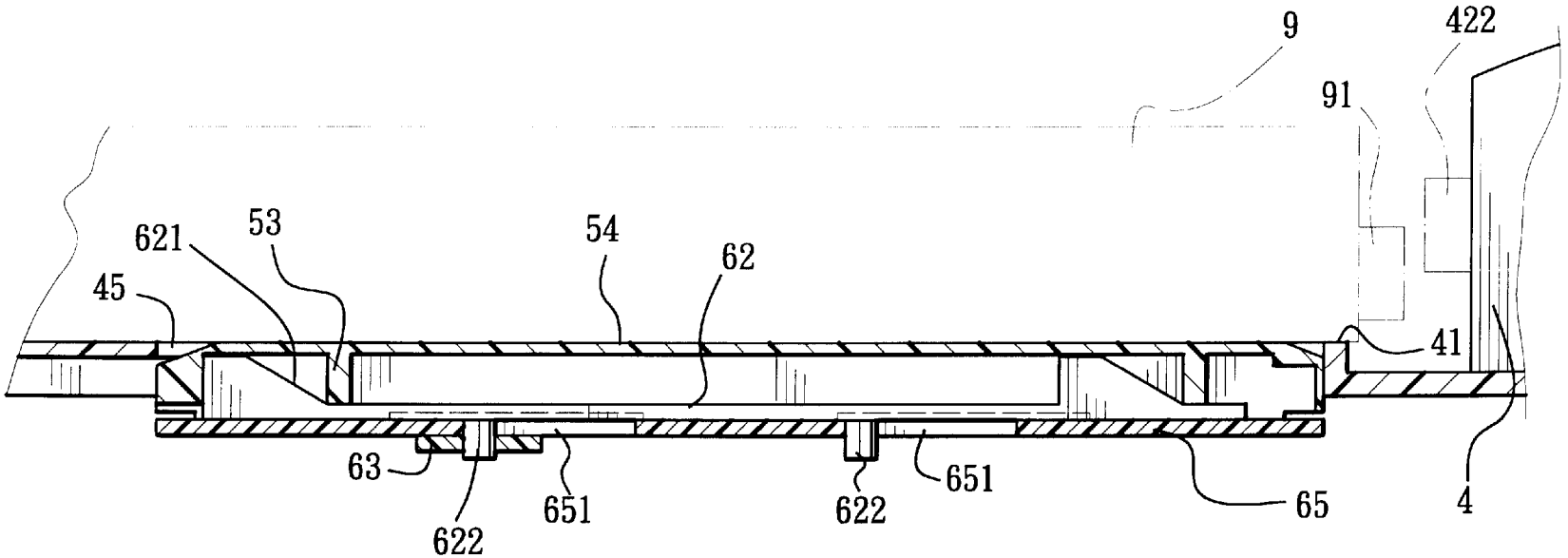
FIG. 5 is a fragmentary cross-sectional view of the interface device according to the present invention, in which a portable computer is in a lower position on a base of the interface device.

The lift mechanism 5 includes two elongated hollow supports 50 disposed respectively below the elongated grooves 45. Each of the hollow supports 50 has front and rear ends, an upper closed wall 54 extending between the front and rear ends thereof, a lower open wall 51 opposite to the upper closed wall 54, and two inner projections 53 formed on an inner face of the upper closed wall 54 adjacent respectively to the front and rear ends of the hollow support 50. Two pairs of tabs 52 are formed respectively on the front and rear ends of each of the hollow supports 50 and extend transversely of the same. The tabs 52 abut against the bottom face 40 of the base 4 to prevent the hollow supports 50 from being disengaged upwardly from the base 4 via the elongated grooves 45. The hollow supports 50 are movable between a lower position wherein the upper closed walls 54 of the hollow supports 50 are located normally below the top face 41 or are flush with the top face 41 of the base 4, as best illustrated in FIG. 5, and an upper position wherein the upper closed walls 54 of the hollow supports 50 project upwardly above the top face 41 of the base 4 when the lift mechanism 5 is actuated by the linkage mechanism 5, as best illustrated in FIG. 7, which will be described in greater detail hereinbelow. As such, the portable computer 9 can be moved upwardly and downwardly relative to the top face 41 of the base 4 so that the mating connector 91 of the portable computer 9 can register with and engage the connector 422 on the base 4, as best illustrated in FIG. 7. The downward movement of the hollow supports 50 relative to the base 4 is limited by two stop plates 65 disposed respectively right below the hollow supports 50 and substantially parallel to the bottom face 40. Each of the stop plates 65 has a first side engaging the positioning rails 46 on a corresponding one of the side walls 401, and a second side secured to the pillars 47 by screw fasteners, as best illustrated in FIG. 4. Each of the stop plates 65 further has two elongated holes 651 that are aligned with one another in the front-to-rear direction.

Figure 8:
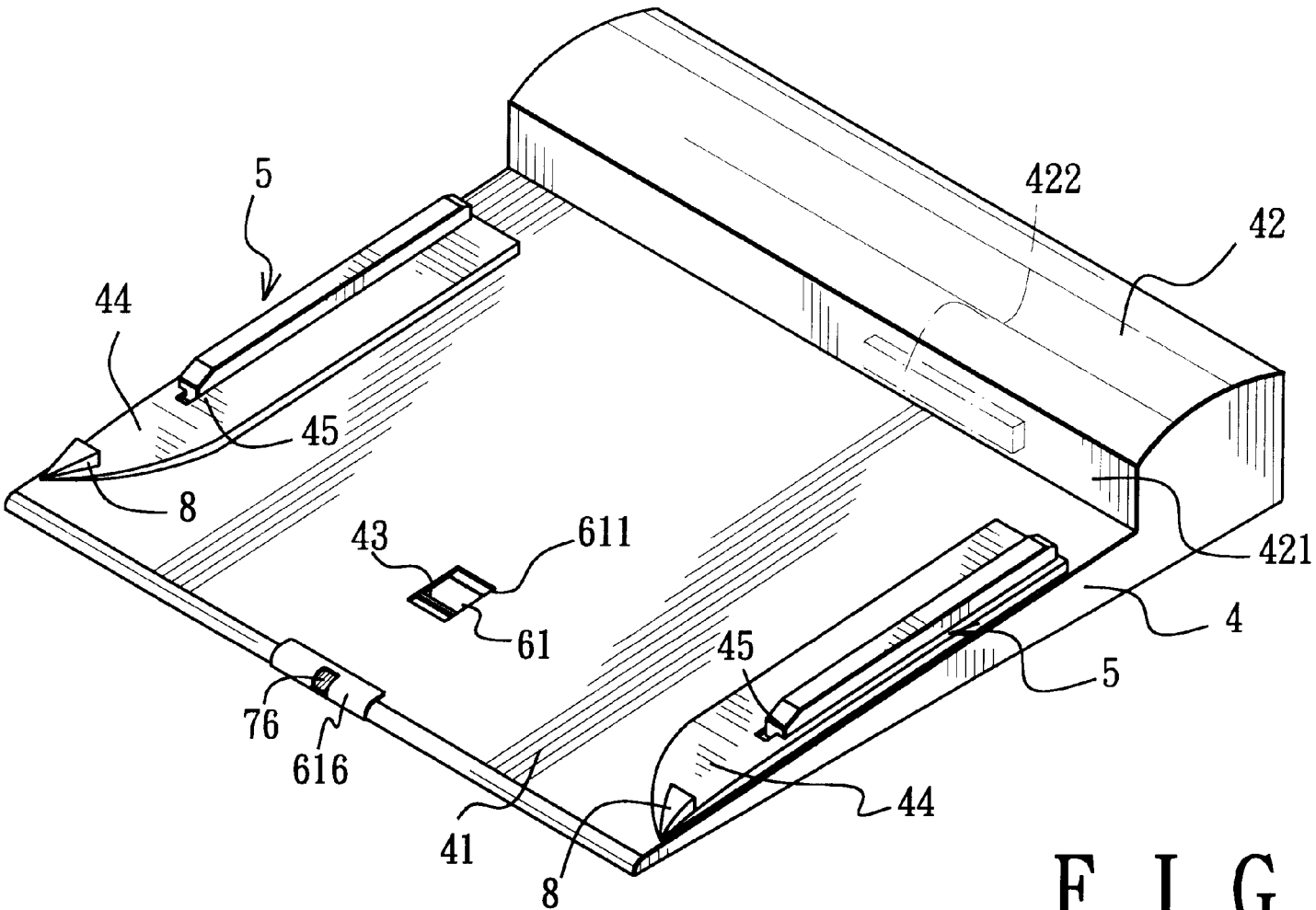
FIG. 8 is a perspective view of the interface device of the preferred embodiment according to the present invention, in which the indication mechanism indicates that the portable computer can be disposed in the upper position on the base of the interface device.

The linkage mechanism 6 is mounted on the base and is connected operatively to the lift mechanism 5 in order to actuate the lift mechanism 5. Specifically, the linkage mechanism 6 includes an elongated slide plate 61, two push rods 62 and two link rods 63. Each of the push rods 62 is received in the corresponding one of the hollow supports 50 and is slidable relative to the corresponding one of the hollow supports 50 in a longitudinal direction of the corresponding one of the hollow supports 50. Each of the push rods 62 has two cam members 621 with inclined faces formed on an upper side thereof, and two pin-like protrusions 622 formed on a lower side thereof and extending respectively into the elongated holes 651 in a corresponding one of the stop plates 65 to guide the sliding movement of the push rods 62. The inclined faces of the cam members 621 on each of the push rods 62 cam respectively the inner projections 53 on the inner face of the upper closed wall 54 of the corresponding one of the hollow supports 50 to move the hollow supports 50 from the lower position to the upper position when the push rods 62 slide relative to the hollow supports 50. The slide plate 61 is disposed slidably below the bottom face 40 of the base 4 in the front-to rear direction. The forward and rearward movement of the slide plate 61 is guided by two guide rails 49 provided on the bottom face 40. The slide plate 61 has a rib 611 projecting upwardly through and slidable in the hole 43 in the base 4 between a front position and a rear position, as shown in FIGS. 8 and 2, respectively. The slide plate 61 further has two lugs 612 formed at a rear end thereof. Each of the lugs 612 has a protrusion 613 formed on an upper side thereof. A positioning plate 64 is secured on the bottom face 40 right below the slide plate 61 to prevent the slide plate 61 from being disengaged from the base 4. Each of the link rods 63 has a pivot hole 631 formed in an intermediate portion thereof, and two elongated holes 632, 633 formed respectively in first and second ends thereof. The pivot hole 631 in each of the link rods 63 engages a corresponding one of the pedestals 40 so that the intermediate portions of the link rods 63 can be fulcrumed on the bottom face 40 of the base 4. The elongated hole 632 in the first end of each of the link rods 63 engages a corresponding one of the protrusions 613 so that the first ends of the link rods 63 are connected pivotally to the slide plate 61. The elongated hole 633 in the second end of each of the link rods 63 engages one of the protrusions 622 on a corresponding one of the push rods 62 so that the second ends of the link rods 63 are connected pivotally to the slide plate 61. As such, the push rods 62 can move upwardly and downwardly the hollow supports 50 between the upper and lower positions when the rib 611 of the slide plate 61 is moved between the front and rear positions to turn the link rods 63.

Figure 6:
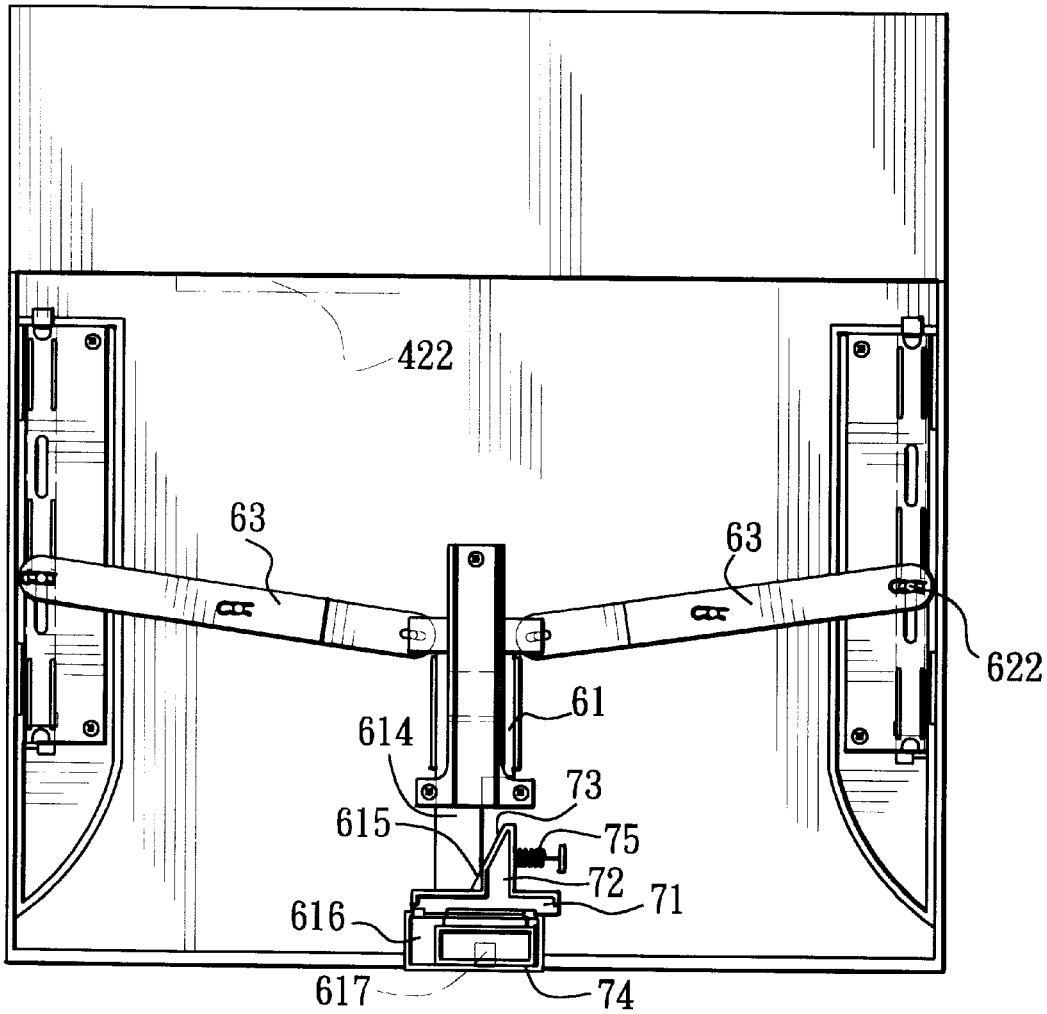
FIG. 6 is a bottom schematic view illustrating the movement of an indication mechanism of the interface device of the preferred embodiment according to the present invention.

Referring to FIGS. 3 and 4, to indicate the position of the hollow supports 50 relative to the base 4, an indication mechanism 7 is provided on the base 4 and is connected operatively to the slide plate 61 to indicate that the rib 611 on the slide plate 61 is in either one of the front and rear positions that correspond to either one of the upper and lower positions of the hollow supports 50. Specifically, the indication mechanism 7 includes a thrust plate 71 having a push portion 72 extending rearwardly therefrom, and an indication portion 74 extending forwardly therefrom. The push portion 72 has an inclined distal edge 73 that engages slidably a mating inclined edge 615 formed on a front end of the slide plate 61. As such, the indication portion 74 is movable between a first position wherein the rib 611 is moved to the rear position, as shown in FIG. 4, and a second position wherein the rib 611 is moved to the front position, as shown in FIG. 6. A spring member 75 is mounted on the bottom face 40 of the base 4 in order to bias the thrust plate 71, and therefore, the indication portion 74 to move from the second position to the first position of the indication portion 74 when the rib 611 is moved from the front position to the rear position. A receiving part 616 is formed on a central portion of the front end of the base 41, and has a window 617 formed in the receiving part 616. Amark 76 is formedon theindicationportion 74 and is exposed at the window 617 when the indication portion 74 is moved to the second position, as shown in FIG. 8.

Referring to FIG. 8, the base 4 has two guide blocks 8 formed adjacent to the front end on the top face 41 at the left and right sides thereof, respectively. The guide blocks 8 guide cooperatively the mating connector 91 of the portable computer 9 to align with the connector 422 on the base 4 in the front-to-rear direction in order to facilitate accurate assembly of the portable computer 9 on the base 4.

In use, the portable computer 9 can be easily and conveniently lifted or lowered with respect to the base 4 by pushing the rib 611 on the slide plate 61 so as to adjust the height of the mating connector 91 of the portable computer 9 relative the top face 41 of the base 4. The object of the present invention is thus met.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An interface device for interconnecting a portable computer and computer peripheral devices, comprising:

a base having a front end, a rear end, left and right sides between said front and rear ends, a top face adapted for placement of the portable computer thereon, a bottom face, and a connector housing formed at said rear end of said base, said connector housing having an upright front wall extending upwardly from said top face of said base, and a connector mounted on said front wall of said connector housing at a predetermined height relative to said top face and adapted for engaging a mating connector of the portable computer;

a lift mechanism mounted on said base and adapted for moving the portable computer upwardly and downwardly relative to said top face of said base so that the mating connector of the portable computer can register with and engage said connector on said base; and a linkage mechanism mounted on said base and connected operatively to said lift mechanism in order to actuate said lift mechanism.

2. The interface device as claimed in claim 1, wherein said base has two elongated grooves respectively adjacent to said left and right sides and extending in a front-to-rear direction, and a hole disposed between said elongated grooves, said lift mechanism including two elongated hollow supports disposed respectively below said elongated grooves, each of said hollow supports having front and rear ends, an upper closed wall extending between said front and rear ends thereof, a lower open wall opposite to said upper closed wall, and two inner projections formed on an inner face of said upper closed wall adjacent respectively to said front and rear ends of said hollow support, said hollow supports being movable between a lower position wherein said upper closed walls of said hollow supports are located normally below said top face of said base, and an upper position wherein said upper closed walls of said hollow supports project upwardly above said top face of said base when said lift mechanism is actuated by said linkage mechanism.

3. The interface device as claimed in claim 2, wherein said linkage mechanism includes a slide plate, two push rods and two link rods, each of said push rods being received in the corresponding one of said hollow supports and being slidable relative to the corresponding one of said hollow supports in a longitudinal direction of the corresponding one of said hollow supports, each of said push rods having two cam members cammed respectively by said inner projections on said inner face of said upper closed wall of the corresponding one of said hollow supports to move said hollow supports from said lower position to said upper position when said push rods slide relative to said hollow supports, said slide plate being disposed slidably below said bottom face of said base in said front-to rear direction, said slide plate having a rib projecting upwardly through and slidable in said hole in said base between a front position and a rear position, each of said link rods having a first end that is connected pivotally to said slide plate, a second end that is connected pivotally to a corresponding one of said push rods, and an intermediate portion that is fulcrumed on said bottom face of said base, said push rods moving upwardly and downwardly said hollow supports between said upper and lower positions when said rib is moved between said front and rear positions to turn said link rods.

4. The interface device as claimed in claim 3, further comprising an indication mechanism mounted on said base and connected operatively to said slide plate to indicate that said rib on said slide plate is in either one of said front and rear positions that correspond to either one of said upper and lower positions of said hollow supports.

5. The interface device as claimed in claim 1, wherein said base has two guide blocks formed adjacent to said front end on said top face at said left and right sides thereof, respectively, and adapted to guide the mating connector of the portable computer to align with said connector on said base in said front-to-rear direction.

6. The interface device as claimed in claim 1, wherein said lift mechanism includes a pair of supports mounted movably on said base, respectively, adjacent to said left and right sides for moving upward and downward relative to said base, said supports extending in a front-to-rear direction, said linkage mechanism being connected operatively to said supports and having a slide plate operable manually to actuate said supports.

* * * * *